US005560606A

United States Patent [19]

David

[11] Patent Number: 5,560,606

[45] Date of Patent: Oct. 1, 1996

[54] CUBICLE MAZE PUZZLE

[76] Inventor: Eliahu David, 2023 Beyer Ave., Philadelphia, Pa. 19155

[21] Appl. No.: 607,320

[22] Filed: Feb. 26, 1996

[51] Int. Cl.[6] ..... A63B 67/14

[52] U.S. Cl. ..... 273/153 R; 273/113

[58] Field of Search ..... 273/153 R, 109, 273/113, 115, 116, 117, 118

[56] References Cited

U.S. PATENT DOCUMENTS

| | | | |
|---|---|---|---|
| 3,840,234 | 10/1974 | Felsten | 273/153 R |
| 4,494,753 | 1/1985 | Wampler | 273/113 |
| 4,545,577 | 10/1985 | Randleman | 273/113 |
| 4,743,023 | 5/1988 | Collier | 273/153 R |
| 4,824,098 | 4/1989 | Huang | 273/113 |
| 4,861,036 | 8/1989 | Watanabe | 273/113 |
| 4,953,502 | 9/1990 | Hoover | 273/153 R |
| 4,953,863 | 9/1990 | Zeidler et al. | 273/113 |

*Primary Examiner*—Steven B. Wong

[57] ABSTRACT

A cubicle maze puzzle including a transparent cubicle main portion having an upper end and a lower end. The main portion has transparent walls formed therein. The walls define a plurality of chambers within the main portion. The walls have a plurality of apertures formed therein defining a tortuous path from an entrance point in the upper end to an exit point in the lower end. The device includes a ball that is dimensioned for receipt within the entrance point of the transparent cubicle main portion for traveling though the tortuous path defined by the plurality of apertures to be ejected outwardly through the exit point.

1 Claim, 3 Drawing Sheets

FIG 1
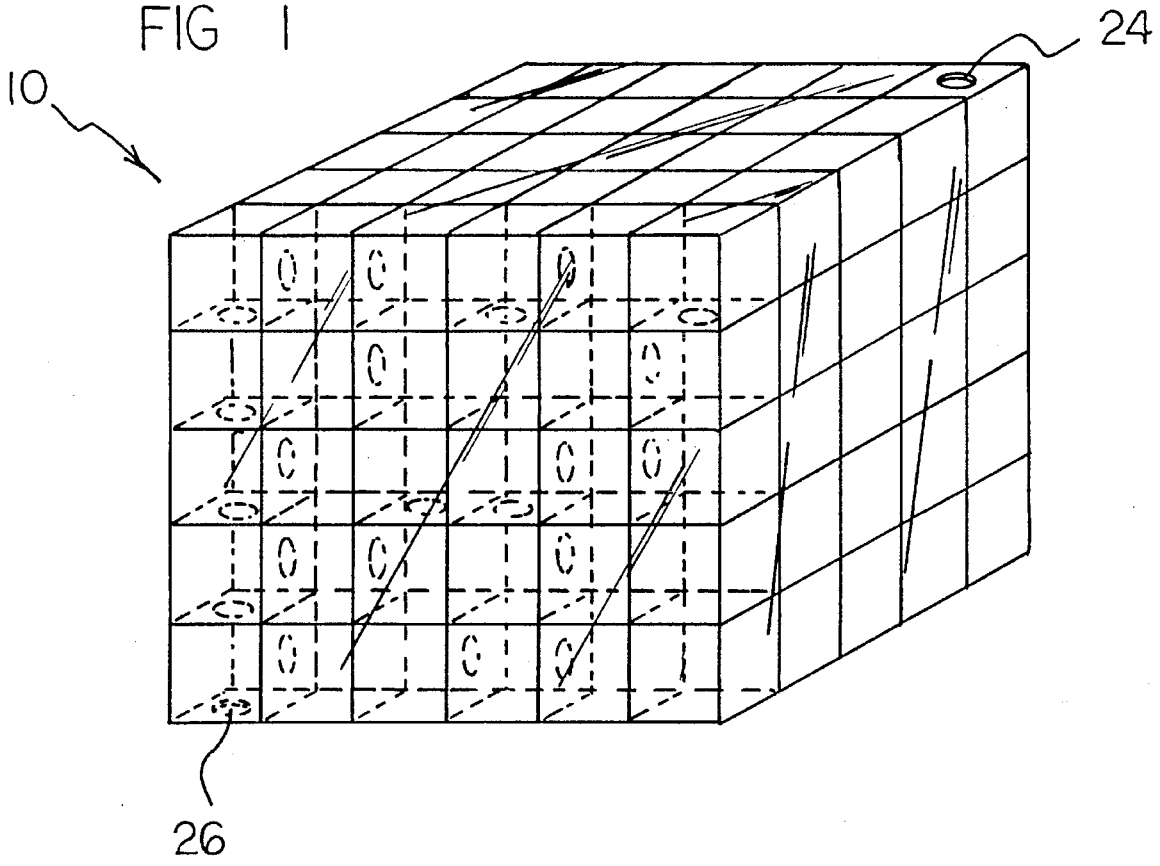
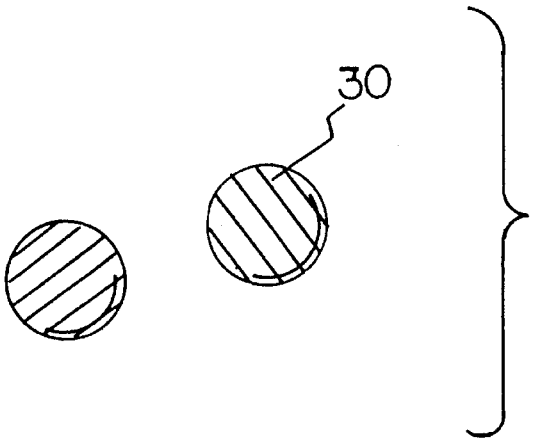
FIG 2

FIG 5
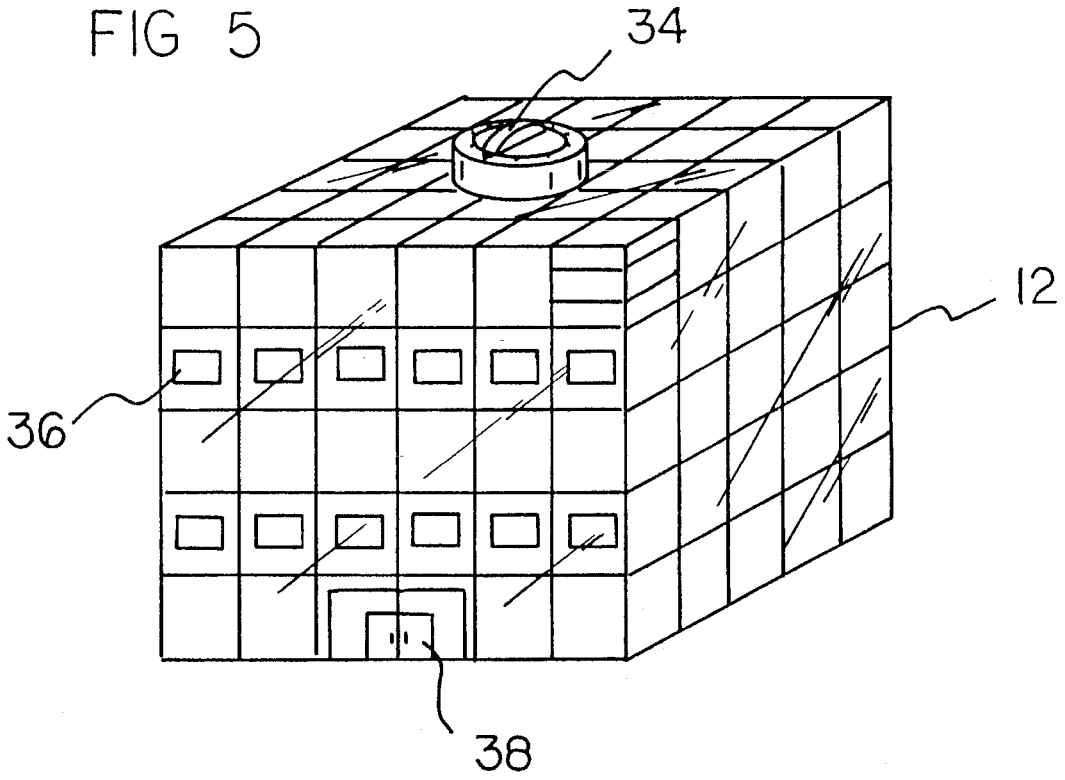
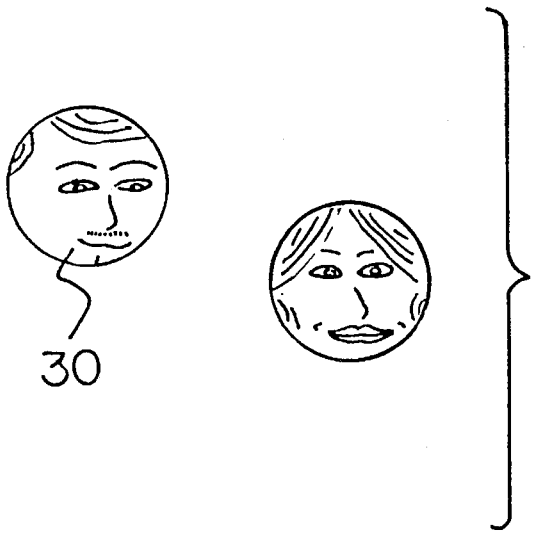
FIG 6

CUBICLE MAZE PUZZLE

BACKGROUND OF THE INVENTION

1. Field of the Invention

The present invention relates to a cubicle maze puzzle and more particularly pertains to passing a ball through a tortuous path from an entrance to an exit with a cubicle maze puzzle.

2. Description of the Prior Art

The use of maze puzzles is known in the prior art. More specifically, maze puzzles heretofore devised and utilized for the purpose of enclosing a ball to travel through a maze are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,787,054 to Stafford discloses a hidden maze puzzle contained ball.

U.S. Pat. No. 5,123,650 to Slauter discloses a multi-panel maze puzzle.

U.S. Pat. No. 5,042,808 to Shoptaugh discloses a labyrinth toy.

U.S. Pat. No. 5,145,174 to Caramanoff discloses a non-visual labyrinth puzzle "Hidden Crazy Maze".

U.S. Pat. No. 4,822,045 to Shoemaker, Jr. discloses a rolling ball game.

While these devices fulfill their respective, particular objective and requirements, the aforementioned patents do not describe a cubicle maze puzzle for passing a ball through a tortuous path from an entrance to an exit.

In this respect, the cubicle maze puzzle according to the present invention substantially departs from the conventional concepts and designs of the prior art, and in doing so provides an apparatus primarily developed for the purpose of passing a ball through a tortuous path from an entrance to an exit.

Therefore, it can be appreciated that there exists a continuing need for new and improved cubicle maze puzzle which can be used for passing a ball through a tortuous path from an entrance to an exit. In this regard, the present invention substantially fulfills this need.

SUMMARY OF THE INVENTION

In the view of the foregoing disadvantages inherent in the known types of maze puzzles now present in the prior art, the present invention provides an improved cubicle maze puzzle. As such, the general purpose of the present invention, which will be described subsequently in greater detail, is to provide a new and improved cubicle maze puzzle and method which has all the advantages of the prior art and none of the disadvantages.

To attain this, the present invention essentially comprises a transparent cubicle main portion having an upper end and a lower end. The main portion has transparent walls formed therein. The walls define sixty-four chambers within the main portion. The walls have a plurality of apertures formed therein defining a tortuous path from an entrance point in the upper end to an exit point in the lower end. The device includes a colored ball that is dimensioned for receipt within the entrance point of the transparent cubicle main portion for travelling though the tortuous path defined by the plurality of apertures to be ejected outwardly through the exit point.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cubicle maze puzzle which has all the advantages of the prior art maze puzzles and none of the disadvantages.

It is another object of the present invention to provide a new and improved cubicle maze puzzle which may be easily and efficiently manufactured and marketed.

It is a further object of the present invention to provide a new and improved cubicle maze puzzle which is of durable and reliable construction.

An even further object of the present invention is to provide a new and improved cubicle maze puzzle which is susceptible of a low cost of manufacture with regard to both materials and labor, and which accordingly is then susceptible of low prices of sale to the consuming public, thereby making such a cubicle maze puzzle economically available to the buying public.

Still yet another object of the present invention is to provide a new and improved cubicle maze puzzle which provides in the apparatuses and methods of the prior art some of the advantages thereof, while simultaneously overcoming some of the disadvantages normally associated therewith.

Even still another object of the present invention is to provide a new and improved cubicle maze puzzle for passing a ball through a tortuous path from an entrance to an exit.

Lastly, it is an object of the present invention to provide a new and improved cubicle maze puzzle including a transparent cubicle main portion having an upper end and a lower end. The main portion has transparent walls formed therein. The walls define a plurality of chambers within the main portion. The walls have a plurality of apertures formed therein defining a tortuous path from an entrance point in the upper end to an exit point in the lower end. The device includes a ball that is dimensioned for receipt within the entrance point of the transparent cubicle main portion for traveling though the tortuous path defined by the plurality of apertures to be ejected outwardly through the exit point.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the cubicle maze puzzle constructed in accordance with the principles of the present invention.

FIG. 2 is a front view of the colored balls used in the device.

FIG. 5 is a perspective view of a second embodiment of the present invention.

FIG. 6 is a front view of the balls used in the second embodiment of the present invention.

The same reference numerals refer to the same parts through the various Figures.

DESCRIPTION OF THE PREFERRED EMBODIMENT

Figure 3:
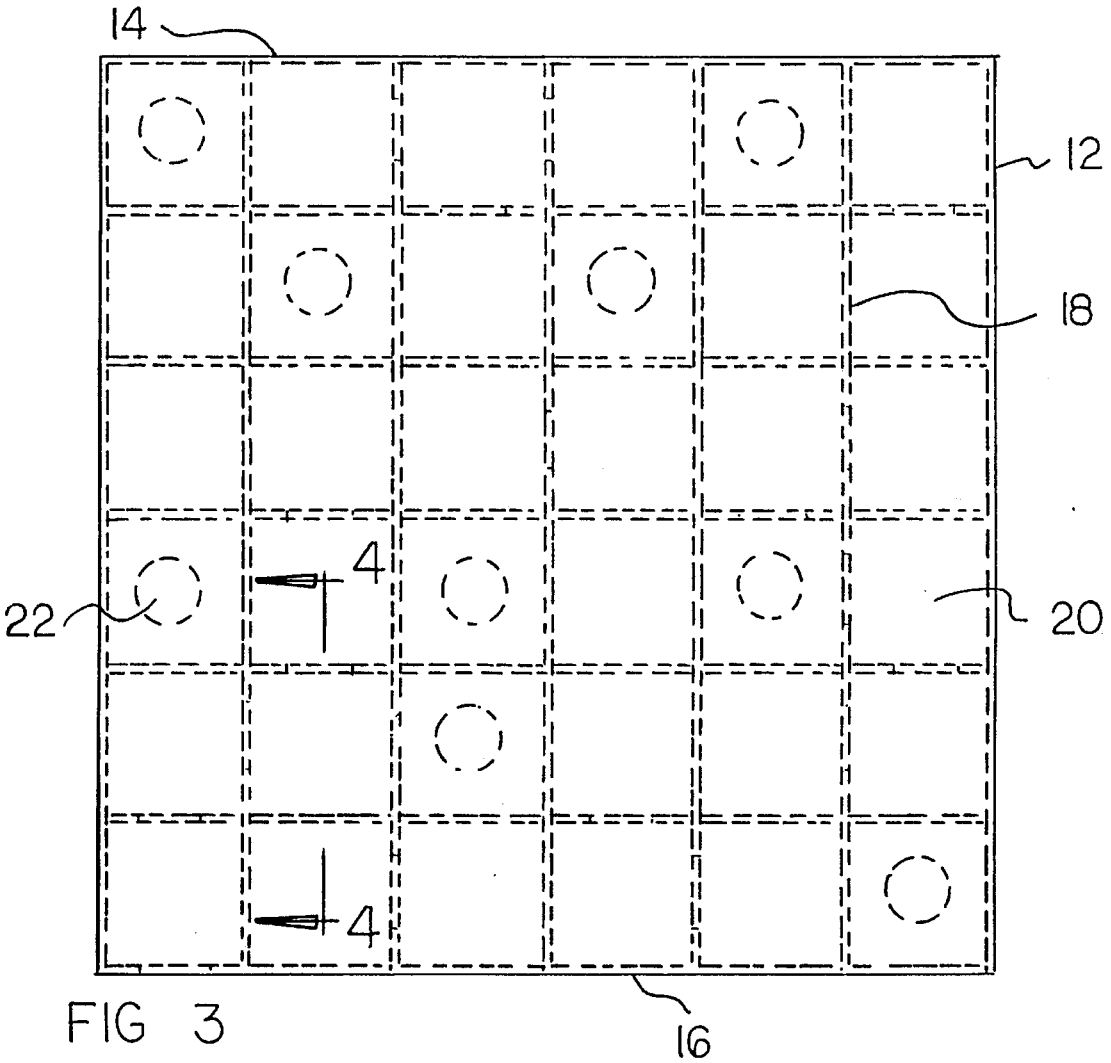
FIG. 3 is an elevated front view of the cubicle of the present invention.
Figure 4:
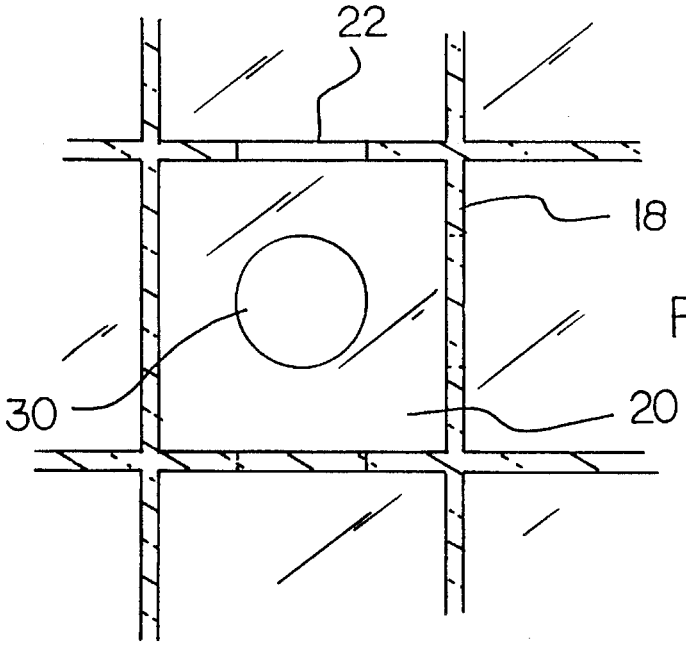
FIG. 4 is a cross-sectional view as taken along line 4—4 of FIG. 3.

With reference now to the drawings, and in particular, to FIGS. 1–4 thereof, the preferred embodiment of the new and improved cubicle maze puzzle embodying the principles and concepts of the present invention and generally designated by the reference number 10 will be described.

Specifically, it will be noted in the various Figures that the device relates to a new and improved cubicle maze puzzle for passing a ball through a tortuous path from an entrance to an exit. In its broadest context, the device consists of a transparent cubicle main portion and a colored ball. Such components are individually configured and correlated with respect to each other so as to attain the desired objective.

The device 10 includes a transparent cubicle main portion 12 having an upper end 14 and a lower end 16. The main portion 12 has transparent walls 18 formed therein. The walls 18 define sixty-four chambers 20 within the main portion 12. The walls 18 have a plurality of apertures 22 formed therein defining a tortuous path from an entrance point 24 in the upper end to an exit point in the lower end 26. The transparent walls 18 can be tinted in different colors to vary the difficulty of the device 10.

The device 10 includes a colored ball 30 that is dimensioned for receipt within the entrance point 24 of the transparent cubicle main portion 12 for travelling through the tortuous path defined by the plurality of apertures 22 to be ejected outwardly through the exit point 26. The user simply places the colored ball 30 into the entrance point 24 and then proceeds to vary the angle of the main portion 12 to direct the colored ball 30 through the plurality of apertures 22 with the objective of ejecting the colored ball 30 out through the exit point 26.

A second embodiment of the present invention is shown in FIGS. 5–6 and includes substantially all of the components of the present invention further including a battery operated timer 34 secured to the upper end 14 of the transparent cubicle main portion 12. Additionally, the cubicle main portion 12 is designed to resemble an office building. The main portion 12 includes windows 36 on its surfaces as well as a door 38 adjacent to its lower end 16. The balls used are designed with faces 38 painted thereon to resemble an employer whether a male or female.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A cubicle maze puzzle for passing a ball through a tortuous path from an entrance to an exit comprising, in combination:

a transparent cubicle main portion having an upper end and a lower end, the main portion having transparent walls formed therein, the walls defining a plurality of chambers within the main portion, the walls having a plurality of apertures formed therein defining a tortuous path from an entrance point in the upper end to an exit point in the lower end;

a ball being dimensioned for receipt within the entrance point of the transparent cubicle main portion for traveling through the tortuous path defined by the plurality of apertures to be ejected outwardly through the exit point; and a battery operated time secured to the upper end of the transparent cubicle main portion.

* * * * *